US006849037B1

(12) United States Patent
Sanders et al.

(10) Patent No.: US 6,849,037 B1
(45) Date of Patent: Feb. 1, 2005

(54) PROTECTIVE SYMMETRICAL PACKAGING PREFORM METHOD

(75) Inventors: Robert T. Sanders, Holly Springs, NC (US); Eric A. Stegner, Durham, NC (US); Robert W. Stegner, Durham, NC (US); Robert F. Weisser, Brighton, MA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/721,206

(22) Filed: Nov. 25, 2003

(51) Int. Cl.[7] ..... B31B 49/00

(52) U.S. Cl. ..... 493/51; 493/79; 493/116; 493/137

(58) Field of Search ..... 493/242, 51, 68, 493/79, 83, 116, 127, 137, 104; 53/390

(56) References Cited

U.S. PATENT DOCUMENTS 3,512,459 A * 5/1970 Difrank ..... 493/124
4,006,670 A * 2/1977 Royal ..... 493/10
5,002,221 A * 3/1991 Ragan ..... 229/120
5,024,641 A * 6/1991 Boisseau ..... 493/171
5,971,906 A * 10/1999 Tharpe et al. ..... 493/131
6,776,746 B2 * 8/2004 Taylor ..... 493/68

* cited by examiner

*Primary Examiner*—Eugene Kim
*Assistant Examiner*—Sameh H. Tawfik
(74) *Attorney, Agent, or Firm*—Joscelyn G. Cockburn

(57) ABSTRACT

A symmetrical preform that provides protection to an equipment component (or other fragile or breakable item), provides ease in use during pre-packing and packing of an equipment component for transport, does not require the need for additional packing components in combination with the packaging assembly, and is economically suited for its end use, is provided for. Accordingly, the present invention provides a method for making an integral, one piece packing assembly having symmetrical characteristics and being comprised of a flexible, corrugated-shaped material that is capable of protectively encapsulating, in a predetermined arrangement, a fragile component to ready for further movement, transport or packaging.

9 Claims, 3 Drawing Sheets

PROTECTIVE SYMMETRICAL PACKAGING PREFORM METHOD

BACKGROUND OF THE INVENTION

1. Field of the Invention

The present invention relates generally to the protective packaging systems and apparatuses therein, and more particularly to a creating a cushioned packaging apparatus preform for protectively accommodating fragile items often associated with electronic equipment, especially during post-manufacturing and transport, without the need for additional packing materials.

2. Description of Related Art

It is known that one way to protect electronic equipment (e.g., computer displays, electronic component boards, thin lead electronics, and the like) is to wrap or surround the equipment in packing foam, bubble wrap or polyurethane pellets before or concurrent with setting such equipment into a shipping container for transport. Other methods includes shipping these electronic components via parallelpiped cardboard containers, specially-molded containers or foam-injected boxing so as to minimize the movement of the equipment during transport. Unfortunately, each of these methods is only satisfactory in protecting the equipment during transport, and each have varied costs associated therewith.

Essentially, each method requires a time-consuming packaging or customization step for preparing and packing each equipment component for shipment, which in turn requires additional labor and adds additional costs (due to the packaging and shipping materials) to the overall equipment cost. In many cases, the packing container is quite oversized as compared to the physical construct of the equipment component to be shipped so as to permit all the various packing materials, needed for shipment, to also be set in place in the packing container. Often, due to the varied need for a plurality of the packing materials as well as the additional labor involvement associated with preparing and setting the packing materials, there also clearly exists an increased likelihood for error in a variety of aspects including the placement of these packing materials in the container and around the equipment component, the inclusion of an adequate amount of packing materials given the container size and equipment component size and value, and the care and handling of the equipment component during this preparatory aspect so as to attempt to mitigate the possibility of accidental breakage due, both before and during shipment, to human error.

SUMMARY OF THE INVENTION

Thus, a packaging apparatus preform that provides protection to an equipment component (or other fragile or breakable item), provides ease in use during pre-packing and packing of an equipment component for transport, does not require the need for additional packing components in combination with the packaging assembly, and is economically suited for its end use, is desired.

Accordingly, the present invention provides a method for creating an integral protective packaging preform usable as a corrugated packaging assembly which overcomes these unresolved problems and deficiencies and sets forth additional advantageous attributes as further detailed by the invention in the manner described hereinbelow.

In accordance with one aspect of the present invention, the present invention is an integral, one piece packing preform comprised of a flexible, corrugated-shaped material that is capable of protectively encapsulating, in a predetermined arrangement, a fragile component to ready for further movement, transport or packaging. Preferably, when the present invention is finally arranged to a predetermined construct form, the present invention provides impact protection to an encapsulated component on all faces of the final predetermined construct form.

In accordance with another aspect of the present invention, the present invention is constructed to be relatively simple in construction, inexpensive in material composition, easy to use, relatively accommodating to arrange to a final predetermined construct form, and reliable in operation.

Preferably, in accordance with another aspect of the present invention, the present invention is a preform comprised of an integral sheet of a die cut, rippled, flexible assembly that when assembled may be assembled to securely and protective encompass a fragile component; preferably, the preform may be shaped into a final package assembly form that is able to "float" one or more fragile components (i.e., an electrical part for example) in an assembly that provides protection on all six faces.

In accordance with yet another aspect of the present invention, the present invention is comprised of materials that are readily recyclable, of low cost and/or are environmentally-friendly.

In accordance with another aspect of the present invention, the present invention may be used as a protective floating tray, encapsulating at least one fragile component, and being insertable into another shipping container.

As used herein, the terms "Equipment Component", "Electronic Component", "Fragile Component" are terms used interchangeably herein to refer to sensitive, fragile or electronic devices, assemblies, instrumentalities or materials (i.e., including but not limited to electronic circuit cards, electronic and computer devices, glass and porcelain materials, breakable items, and similar) that often must be specially wrapped or handled during shipment, transport or when moving from one point to another. Typically, though not necessarily, it is envisioned that certain of these types of electronic components and electronic devices may also be sensitive to radiofrequency (RF) interference, electric field interference (EFI), or electric, electrical, electronic, physical, and/or static shock, and similar. Similarly, the use of the term "front" or "back" to designate a side of the material sheet which is used in the present invention is not used as a limiting term but rather is used to assist in providing clarity to and understanding of the present invention.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Figure 1:
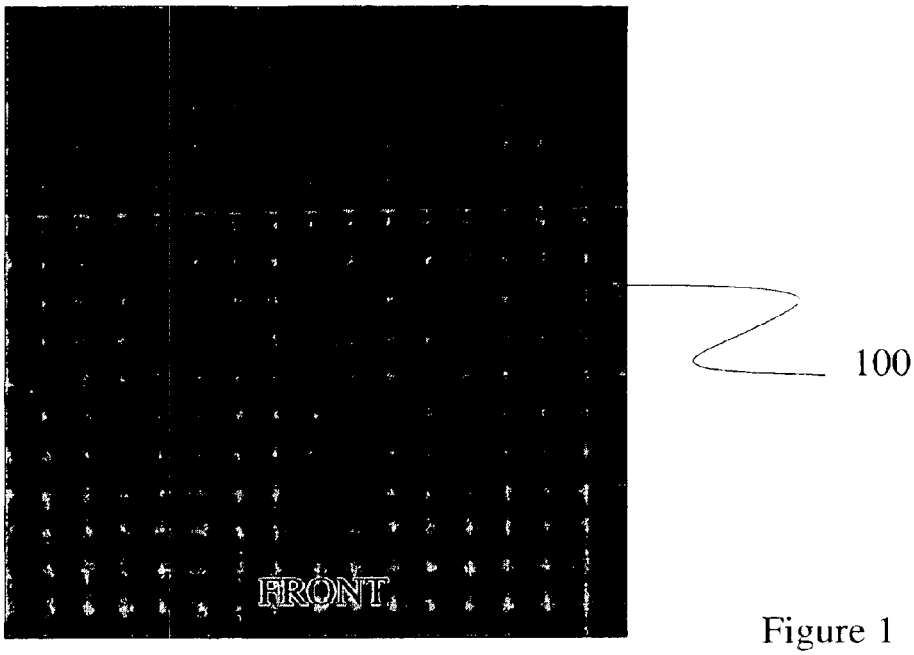
FIG. 1 is an overhead view of a front side of a sheet of material used to construct the packaging float tray preform of the present invention.

The use of figure reference labels in the claims is intended to identify one or more possible embodiments of the claimed subject matter in order to facilitate the interpretation of the claims. Such labeling is not to be construed as necessarily limiting the scope of those claims to the embodiments shown in the corresponding figures. The preferred embodiments of the present invention and its advantages are best understood by referring to the drawings, like numerals being used for like and corresponding parts of the various drawings. Reference herein to "one embodiment" or "an embodiment" means that a particular feature, structure, or characteristic described in connection with the embodiment can be included in at least one embodiment of the invention, but not necessarily in all. The appearances of the phrase "in one embodiment" in various places in the specification, sequentially or otherwise, does not necessarily indicate that each phrase refers to or is used in reference to the same embodiment, nor are separate or alternative embodiments mutually exclusive of other embodiments. The description herein is largely based on a particular packaging system and method based on the use of a single, unitary packaging instrument, as developed by the inventors identified above. Those skilled in the art will appreciate that the description can be equally applied to other packaging systems and methods.

FIG. 1 is an overhead view of the front side of a sheet of material 100 used to construct the packaging float tray preform of the present invention.

Figure 2:
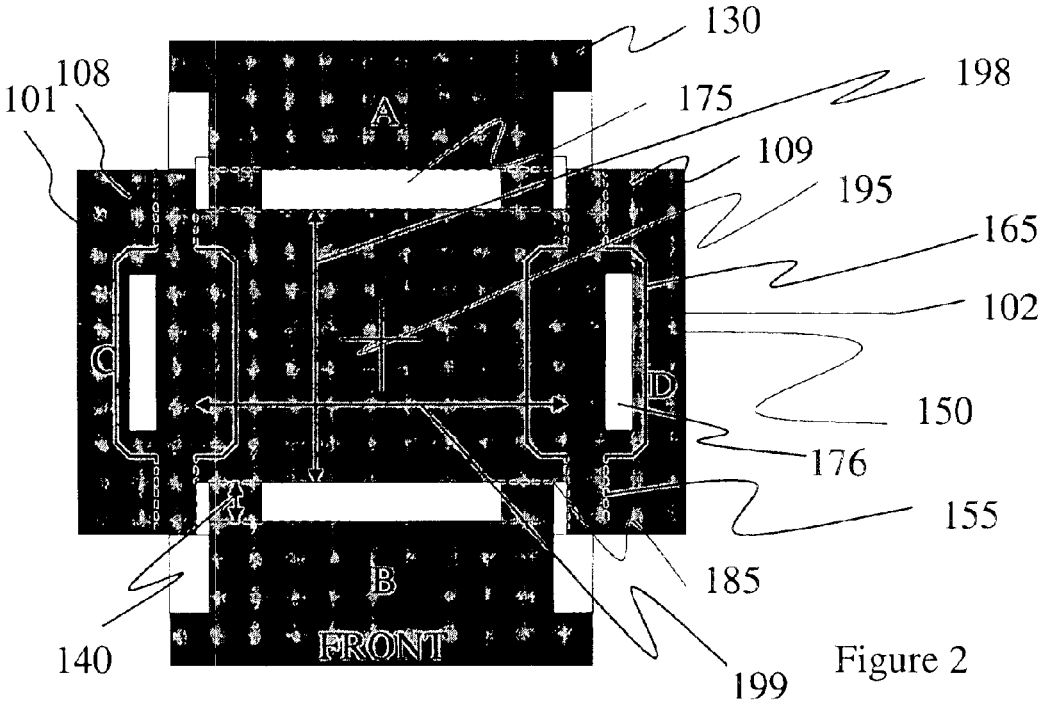
FIG. 2 is an overhead view of a front side of the material sheet of FIG. 1 following forming the material into a predetermined preform, from which the packaging float tray assembly can be formed to a final construct form by folding and connecting the respective associated portions thereof, in accordance with an embodiment of the present invention.

FIG. 2 is an overhead view of the front side of a sheet material sheet of FIG. 1 (100) following forming 150, prior to assembly of the packing, in a predetermined preform 150, from which the packaging float tray assembly can be formed to a final construct form by folding and connecting the respective associated portions thereof, in accordance with an embodiment of the present invention. As show in FIG. 2, the material sheet has assumed a predetermined preform pattern.

The preform pattern is of a predetermined preform arrangement suitable for a particular embodiment and the depiction of the preform herein is not limiting to the present invention but rather instructive. The preform shape is predetermined in part based upon the component to be packaged, and the material sheet is formed in accordance with the preform shape such that unnecessary material is removed from the material sheet to create the preform of the packaging assembly. As part of the preform, there is at least one component viewing void 175, slits 176, packaging cutouts 185, at least one fold 155, at least one precut 165, at least one tab edge 130 and a center point 195. There is also an upper edge of side C at 101 and an upper edge of side D at 102.

As shown in FIG. 2, the preform of the present invention is symmetric about its center point in both a vertical and a horizontal cross section, and contains identical voids 175, slits 176, cutouts 185, folds 155, and precuts 165 symmetric about the center pont 195. In a preferred arrangement, the preform is arranged so the voids 175 are of a dimension that is less than the side dimension of an encapsulated component, such that when the assembly is folded to encapsulate a component, the component is visible within the package assembly by viewing through the void. The additional benefit to a smaller void dimension is that the encapsulated component is unable to slip out during shipment. Similarly, the vertical distance between voids 198 is slightly larger than the associated vertical size of the component to be encapsulated and the horizontal distance between the left side C and the right side D, as further diagramed in FIG. 2, is slightly larger than the associated horizontal size of the component to be encapsulated. Further, the dimension of the preform at 140 is preferably just slightly grater than the height dimension of the component to be encapsulated. In an alternative arrangement, the voids are not necessary to the present invention. Additionally, as used herein and by way of example, A indicates a distal side and B indicates a proximal side, as further identified in FIG. 2.

For the avoidance of doubt, when determining the length, width and height dimensions of the preform (i.e., 198, 199, 140), it is important to include also include the value of the thickness of the material component which is used to construct the package assembly. For instance, where the material component is that of corrugated cardboard, having a dimensional thickness of ¼ inch, then each dimension of the package assembly should be determined by measuring the component (to be encapsulated) dimension and then adding ½ inch to each dimension to determine the minimum dimensions for the preform. In a preferred arrangement, tab edges 130 are arranged to be insertable into slits 176 in relation to the component to be encapsulated.

Figure 3:
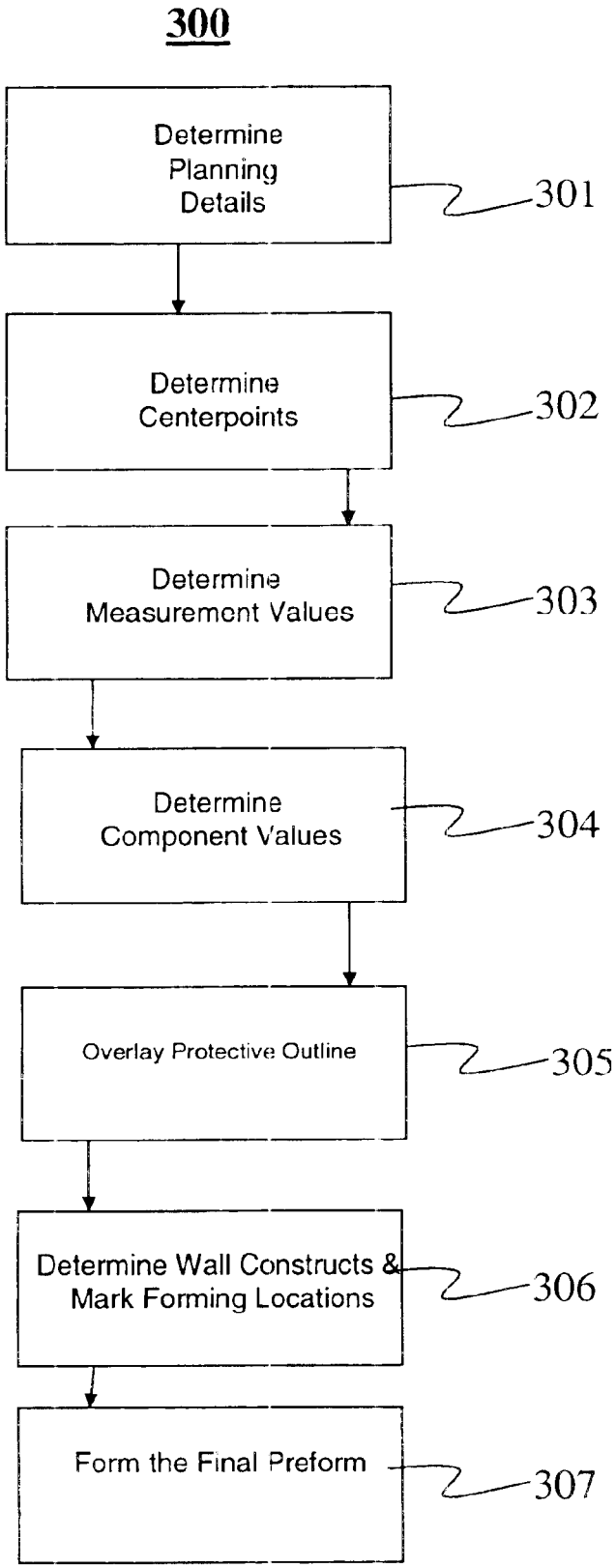
FIG. 3 is a flowchart of a method of the present invention for forming a predetermined preform in relation to a component to be accommodated thereby.

FIG. 3 is a flowchart 300 of a method of the present invention for forming a predetermined preform in relation to a component to be accommodated thereby.

From FIG. 3, preform material sheet details 301, including shape and material stock, are selected in relation to a component to be protectively encompassed therein. Preferably, a material sheet shape having an approximate polygonal shape as that of a component to be encompassed is selected (i.e., a square shape for an approximate square-shaped component) and a material sheet stock having a protective and insulative quality such as that of corrugated cardboard or strengthened polyfoam are selected. Once the details are selected, a determination of the centerpoint of the material sheet is determined as is the centerpoint of the component along the same axial plane (horizontal) 302. The depth of the component is then measured and an additional value of two times the thickness of the material stock is added to the overall measurement; from this value, the mid point height of an associated side wall of the preform may be determined by taking the value and dividing by two 303. Similarly, at 304, the component dimensions are determined and a value of at least two times the thickness of the material sheet is added to the length and width of the component to create a protective outline of the component. Alternatively, the component to be encapsulated by the preform may have additional secondary dimension to include a wrapping, insulation or other covering which is readily included in the determination of the component dimensions. At 305, the protective outline of the component is then overlayed on the material sheet wherein said protective outline is overlayed in relation to the centerpoint of the material sheet determined earlier. Once overlayed, left and right side walls may be determined and distal and proximal walls may be determined in relation to the protective perimeter set forth by the protective outline, 306. Accordingly, markings may be made on the material sheet in relation to the protective outline to indicate areas requiring further service (such as folding, cutting, removal, etc.).

In a preferred embodiment, a square shape is predetermined in part based upon the square component to be packaged, and the material sheet is comprised of corrugated cardboard. A determination of the centerpoint of the material sheet is determined as is the centerpoint of the component along the same axial plane (horizontal) 302. The depth of the component is then measured and an additional value of two times the thickness of the material stock is added to the overall measurement; from this value, the mid point height of an associated side wall of the preform may be determined by taking the value and dividing by two 303. Similarly, at 304, the component dimensions are determined and a value of at least two times the thickness of the material sheet is added to the length and width of the component to create a protective outline of the component. Alternatively, the component to be encapsulated by the preform may have additional secondary dimension to include a wrapping, insulation or other covering which is readily included in the determination of the component dimensions. At 305, the protective outline of the component is then overlayed on the material sheet wherein said protective outline is overlayed in relation to the centerpoint of the material sheet determined earlier. Once overlayed, left and right side walls may be determined and distal and proximal walls may be determined in relation to the protective perimeter set forth by the protective outline, 306. Accordingly, at 306, markings may be made on the material sheet in relation to the protective outline to indicate areas requiring further service (such as folding, cutting, removal, forming, etc.). At 307, once all areas requiring further forming are indicated, said areas may be formed so as to modify the material sheet into a final preform in accordance with the process. Thereafter, the preform may be used in a packaging process to protect and insulate an encompassed or encapsulated component for further movement, shipping, and the like.

Figure 4:
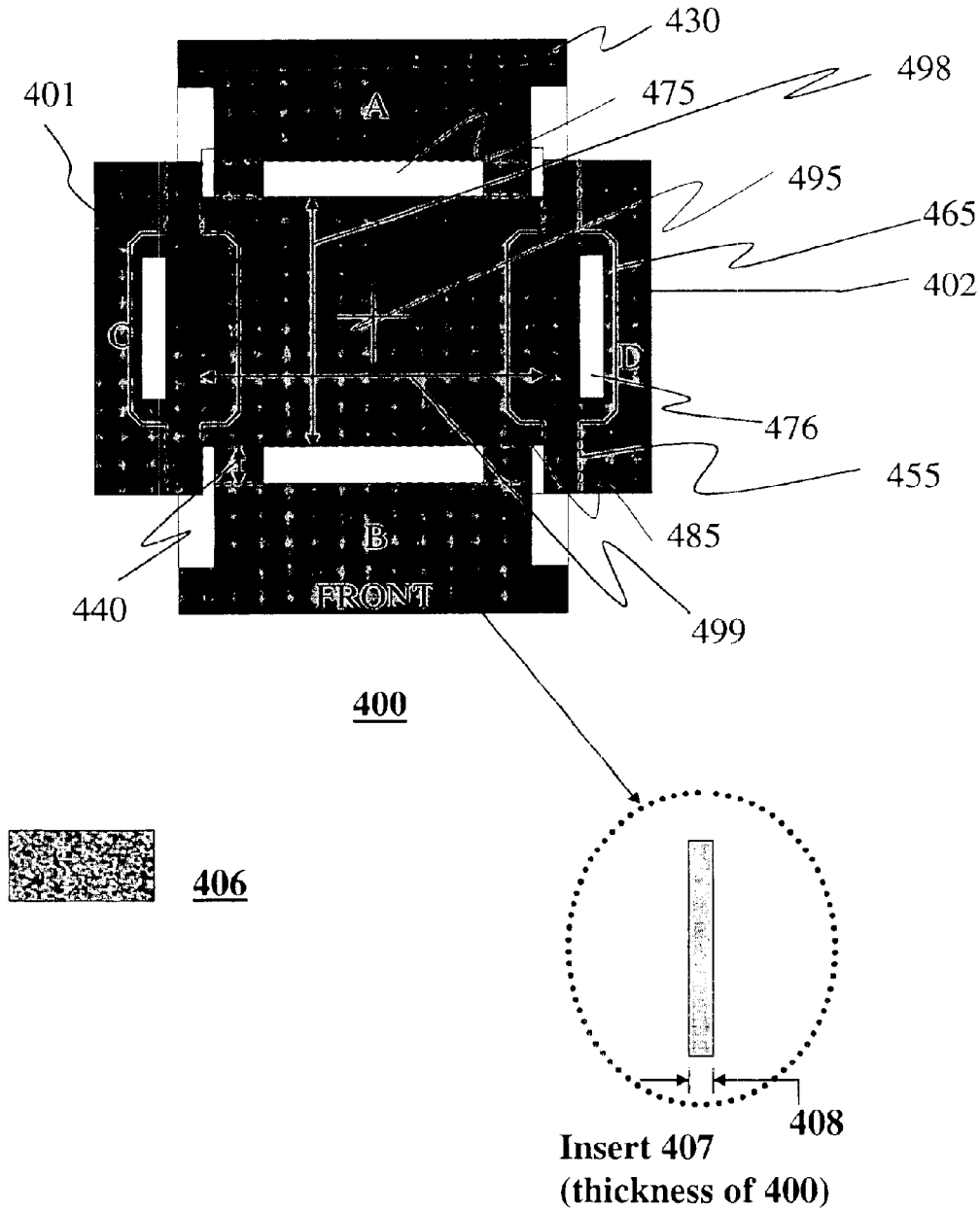
FIG. 4 is another example of a preform of the present invention in a further embodiment in relation to a component and an insert highlighting the thickness of the preform material sheet.

FIG. 4 is another example of a preform 400 of the present invention in a further embodiment in relation to a component 406 and an insert 407 highlighting the thickness 408 of the preform material sheet 400. In FIG. 4, there is at least one component viewing void 475, slits 476, packaging cutouts 485, at least one fold 455, at least one precut 465, at least one tab edge 430 and a center point 495. Preferably, there is also an upper edge of side C at 401 and an upper edge of side D at 402.

As shown in the preferred embodiment of FIG. 4, the preform of the present invention is symmetric about its center point in both a vertical and a horizontal cross section, and contains identical voids 475, slits 476, cutouts 485, folds 455, and precuts 465 symmetric about the center pont 495. In a preferred arrangement, the preform is arranged so the voids 475 are of a dimension that is less than the side dimension of an encapsulated component, such that when the assembly is folded to encapsulate a component, the component is visible within the package assembly by viewing through the void. The term voids, as used herein, may also refer to viewing voids or viewing windows herein.

The additional benefit to a smaller void dimension is that the encapsulated component is unable to slip out during shipment and that a security inspection prior to shipment or post-receiving will assist in favorably demonstrating the presence or absence of the desired component by merely viewing the presence or absence through the void. Similarly, the vertical distance between voids 498 is slightly larger than the associated vertical size of the component to be encapsulated and the horizontal distance between the left side C and the right side D, is slightly larger than the associated horizontal size of the component to be encapsulated. Further, the dimension of the preform at 440 (the height dimension of a side wall) is preferably just slightly greater than the height dimension of the component to be encapsulated. Similarly, 499 is a measurement of the width as between the side walls, C and D, that would be formed following the forming step of folding, wherein the width would be equal to at least a measurement equal to the width of the component, with concessions and/or allowances for the thickness of the material sheet when side walls are folded.

From FIG. 4, an insert 407 is also depicted to indicate that the material sheet has a thickness associated with it having a measurement of 408. Said thickness is used in making certain determinations as to placement of cutout, folds, viewing windows, and the like.

For the avoidance of doubt, when determining the length, width and height dimensions of the preform (i.e., 498, 499, 440), it is important to include also include the value of the thickness of the material component which is used to construct the package assembly. For instance, where the material component is that of corrugated cardboard, having a dimensional thickness of ¼ inch, then each dimension of the package assembly should be determined by measuring the component (to be encapsulated) dimension and then adding ½ inch to each dimension to determine the minimum dimensions for the preform. In a preferred arrangement, tab edges 430 are arranged to be insertable into slits 476 in relation to the component to be encapsulated.

Accordingly, the assembly may be provided in a kit form as well, where the preform is supplied in concert with the component, and optionally, with an encompassing shipping container. As used herein, sealing means and securing material shall include but not be limited by materials and sealant technologies such as tape, glue, thermal activated adhesives and the like. Similarly, it is envisioned that instructions may also accompany a preform in a kit form to be instructive as to how to assemble said preform into a package assembly.

It will be further understood that various changes in the details, materials, and arrangements of the parts which have been described and illustrated in order to explain the nature of this invention may be made by those skilled in the art without departing from the principle and scope of the invention as expressed in the following claims. Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

What is claimed is:

1. A method of forming a protective package preform from a single material sheet having symmetrical attributes, comprising:

a) determining a thickness of a material sheet and a composition of said material sheet, b) determining dimensions of a component to be packaged c) identifying locations on said sheet for voids, slits and folds, wherein each of said voids, slits and folds are symmetrical about a common axis of said sheet, d) placing an overlay of dimensions of said component onto said material sheet at about a center point e) determining a first fold location in relation to a first side and a second fold location in relation to a second side of said material sheet wherein said first fold location and said second fold location are each equidistant from said center point of said material sheet and said first fold location and said second fold location are in positioned in arrangement with respect to each other such that said first side and second side are dimensionally similar, f) determining a first slit location for a first slit on said first side in relation to a first tab located on a left edge of a proximal side and a second slit location for a second slit on second side in relation to a second tab located on a right edge of said proximal side, wherein a third tab is located on a left edge of a distal side and is insertably positionable with said first slit and a fourth tab is located on a right edge of a distal side and is insertably positionable with said second slit, g) determining at least one cutout location in relation to each corner of said material sheet and in relation to said component dimensions, h) determining a height dimension of said proximal side and said distal side in relation to a height dimension of said component, wherein each height dimension is equal to one another, and i) determining at least one viewing void location on said proximal side and at least one viewing void location on said distal side wherein said proximal side viewing location and said distal side view location are arranged symmetrically about and equidistant from said center-point.

2. The method of claim 1, further comprising forming said material sheet into a final preform wherein said cutouts, slits and voids are removed from said material sheet.

3. The method of claim 2, wherein said fold locations are physically marked to indicate a fold location.

4. The method of claim 2, wherein said material sheet is comprised of corrugated cardboard.

5. The method of claim 2, further comprising prefolding each fold location.

6. The method of claim 2, wherein said preform and said component are combined in a kit.

7. The method of claim 2, wherein said component comprises at least two electrical components.

8. The method of claim 2, further comprising assembling said preform as instructed in accompanying instructions so as to form a package assembly.

9. The method of claim 8, forming a protective packaging kit.

* * * * *